US012545484B1

(12) United States Patent
Ning

(10) Patent No.: US 12,545,484 B1
(45) Date of Patent: Feb. 10, 2026

(54) CONTAINER LID

(71) Applicant: Jiacheng Ning, Hunan (CN)

(72) Inventor: Jiacheng Ning, Hunan (CN)

( * ) Notice: Subject to any disclaimer, the term of this patent is extended or adjusted under 35 U.S.C. 154(b) by 0 days.

(21) Appl. No.: 19/194,032

(22) Filed: Apr. 30, 2025

(30) Foreign Application Priority Data

Apr. 11, 2025 (CN) ..... 202520692757.5

(51) Int. Cl.
*B65D 51/00* (2006.01)
*B65D 47/06* (2006.01)
*B65D 51/24* (2006.01)

(52) U.S. Cl.
CPC ..... *B65D 51/007* (2013.01); *B65D 47/061* (2013.01); *B65D 51/242* (2013.01)

(58) Field of Classification Search
CPC ... B65D 51/007; B65D 47/061; B65D 51/242
USPC ..... 220/212.5, 740
See application file for complete search history.

(56) References Cited

U.S. PATENT DOCUMENTS 3,107,029 A * 10/1963 Rylander ..... A47G 23/0266 215/396
3,893,582 A * 7/1975 Kowalik ..... B65D 50/046 215/221
4,322,012 A * 3/1982 Conti ..... B65D 41/3442 215/DIG. 1
4,534,482 A * 8/1985 Bouche ..... B65D 45/322 215/272
4,770,307 A * 9/1988 Guglielmi ..... B65D 45/02 215/272
5,273,176 A 12/1993 Diaz
5,402,904 A 4/1995 Close
5,615,788 A * 4/1997 Larguia ..... B65D 55/06 215/276
6,478,179 B1 11/2002 Alexander
8,561,834 B2 * 10/2013 Ziegler ..... A47G 23/0233 220/737
11,518,583 B2 * 12/2022 Hawes ..... B65D 81/3869
2003/0178433 A1 9/2003 Adams
2004/0026354 A1 * 2/2004 Folchini ..... B65D 45/325 215/277
2018/0332987 A1 * 11/2018 Lin ..... B65D 47/305

* cited by examiner

*Primary Examiner* — James N Smalley
(74) *Attorney, Agent, or Firm* — S.J. Intellectual Property Ltd.

(57) ABSTRACT

The present disclosure provides a container lid, including a lid body and a locking ring. The lid body has a peripheral outer wall, on which at least one elastic locking strip is arranged, and each elastic locking strip undergoes elastic deformation toward an inside of the lid body. The peripheral inner wall of the locking ring container rotates coaxially along the peripheral outer wall, and a locking protrusion is arranged on the peripheral inner wall corresponding to each elastic locking strip. When the locking ring rotates to a preset angle relative to the lid body, the elastic locking strip fastens the top of the container body with elastic deformation.

12 Claims, 11 Drawing Sheets

CONTAINER LID

CROSS REFERENCE TO RELATED APPLICATIONS

This application claims priority benefits to Chinese Patent Application No. 2025206927575, filed on Apr. 11, 2025, the contents of which are incorporated herein by reference.

TECHNICAL FIELD

The present disclosure relates to the technical field of outer packaging products for drinking containers, and particularly, relates to a lid for a pull-tab can.

BACKGROUND

Containers with pull-tabs are commonly used for accommodating beverages, dominating the beverage market due to their convenience. Canned beverages impose limitations due to their sealing manner, i.e., difficult to carry after being opened and necessitates immediate consumption.

SUMMARY

A container lid includes a lid body and a locking ring. The lid body has a peripheral outer wall, the peripheral outer wall is arranged with at least one elastic locking strip, the at least one elastic locking strip is configured to undergo elastic deformation toward an inside of the lid body under an external force. The locking ring has a peripheral inner wall, the peripheral inner wall is sleeved on the peripheral outer wall to rotate coaxially along the peripheral outer wall, and the peripheral inner wall is arranged with at least one locking protrusion corresponding to the at least one elastic locking strip. The at least one locking protrusion abuts against the at least one elastic locking strip to allow the at least one elastic locking strip to fasten the top of the container body by elastic deformation in response to the locking ring rotating to a preset angle relative to the lid body.

BRIEF DESCRIPTION OF THE DRAWINGS

The drawings that form part of the present disclosure are provided to further illustrate the present disclosure. The illustrative embodiments and their descriptions of the present disclosure are intended to explain but do not constitute an undue limitation on the present disclosure.

DETAILED WAY

Figure 1:
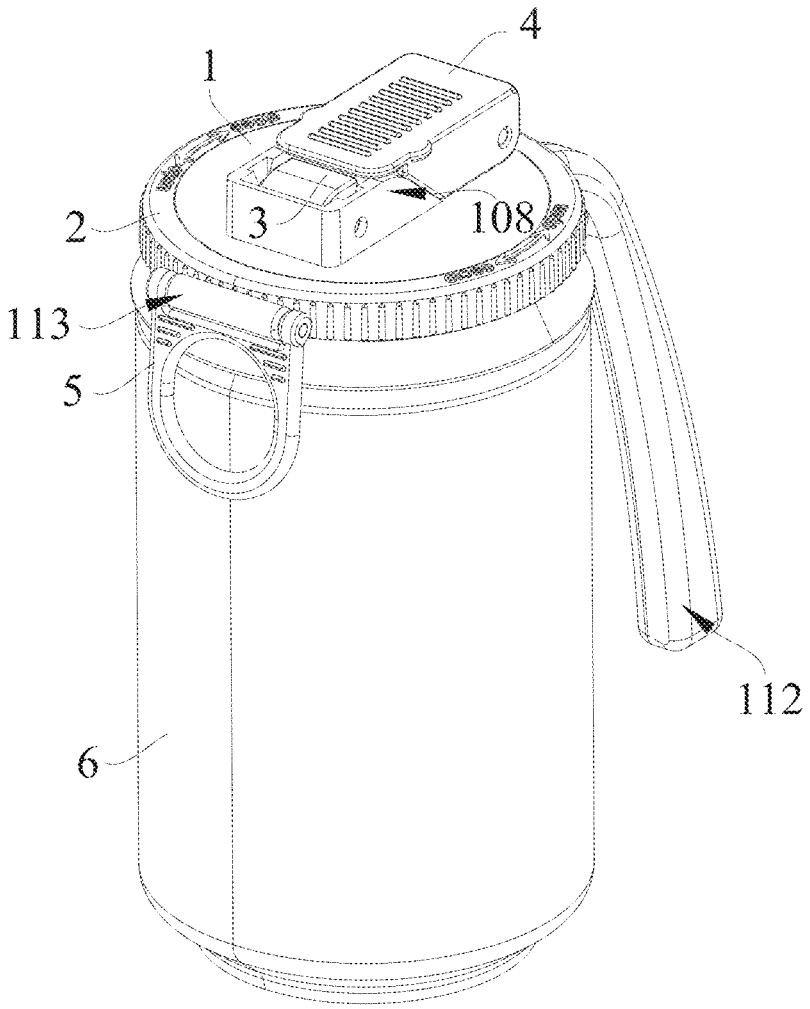
FIG. 1 is a perspective view of a container lid in a closed state at a first angle according to some embodiments of the present disclosure.

The present disclosure is described in detail below with reference to the accompanying drawings and in conjunction with various embodiments. Each example is provided to explain but not to constitute undue limitation on the present disclosure. In fact, it is clear to those of ordinary skill that modifications and variations may be made without departing from the scope or spirit of the present disclosure. For example, a feature shown or described as a part of some embodiments may be used by some embodiments to produce yet some embodiments. Therefore, it is intended that the present disclosure includes such modifications and variations within the scope of the appended claims and their equivalents.

In the description of the present disclosure, the terms "longitudinal", "lateral", "upper", "lower", "front", "back", "left", "right", "vertical", "horizontal", "top", "bottom" and the like indicate the orientational or positional relationships based on the orientational or positional relationships illustrated in the drawings, which are only for the convenience of describing and do not require the present disclosure to be constructed and operated in a specific orientation, and therefore shall not be understood as limitation on the present disclosure. The terms "connected", "connecting" and "arranged" used in the present disclosure should be understood in a broad sense. For example, it may be a fixed connection or a detachable connection; it may be directly connected or indirectly connected through an intermediate component; it may also be a wired electrical connection, a radio connection, or a wireless signal connection. For those of ordinary skill in the art, the specific meanings of the above terms may be understood according to the specific circumstances.

One or more examples of the present disclosure are illustrated in the attached drawings. Characters and letters are used in the detailed description to refer to features in the drawings. Similar signs in the drawings and descriptions have been configured to refer to similar parts of the present disclosure. As used herein, the terms "first", "second" and "third" are used interchangeably to distinguish one component from another and are not intended to indicate the position or importance of each component.

Responsive to the phenomenon that canned beverages impose limitations due to their sealing manner, i.e., difficult to carry after being opened and necessitates immediate consumption, resealing lids for canned beverage have appeared on the market. Most of these commercially available lids need to be directly tightened on the outer rim of the container to reseal the container mouth.

However, after the container is opened, the gas inside leaks out rapidly from the container mouth, resulting in the container susceptible to deformation. After tightening the lid with an external force, the container is often deformed, thereby affecting the sealing effect of the lid on the can.

Therefore, how to seal the opened canned beverages is a technical problem that needs to be solved urgently.

As shown in FIG. 1 to FIG. 11, according to some embodiments of the present disclosure, a container lid is provided. The container lid includes a lid body 1 and a locking ring 2. A peripheral inner wall 201 of the locking ring 2 is sleeved on a peripheral outer wall 101 of the lid body 1. The locking ring 2 can rotate relative to the lid body 1 along the peripheral outer wall 101 of the lid body 1.

In some embodiments, as shown in FIG. 1 to FIG. 4, a plurality of elastic locking strips 103 are provided on the peripheral outer wall 101 of the lid body 1. A block-shaped locking protrusion 202 is provided on the peripheral inner wall 201 of the locking ring 2 corresponding to each elastic locking strip 103. When the locking ring 2 rotates to a preset angle relative to the lid body 1, the locking protrusion 202 abuts against one corresponding elastic locking strip 103, allowing the elastic locking strip 103 elastically deforms to engage with a top of a container body 6.

In some embodiments, as shown in FIG. 1 to FIG. 4, the peripheral outer wall 101 of the lid body 1 defines a plurality of through-grooves 102 extending along the peripheral outer wall 101. One end of each through-groove 102 is connected to a first end 103*a* of a corresponding elastic locking strip 103, and a preset distance is defined between a second end 103*b* of each elastic locking strip 103 and another end of the corresponding through-groove 102, forming an escape groove 102*a* for accommodating a corresponding locking protrusion 202. When the lid body 1 is not locked to the container body 6 by the locking ring 2, the plurality of locking protrusions 202 on the peripheral inner wall 201 of the locking ring 2 are respectively disposed into the corresponding escape grooves 102*a*. When the locking ring 2 rotates relative to the lid body 1 to allow the lid body 1 to lock the container body 6 by the locking ring 2, each locking protrusion 202 fits with its corresponding elastic locking strip 103. During the rotation of the locking ring 2 relative to the lid body 1, each locking protrusion 202 provides an extrusion force toward an inside of the lid body 1 to the corresponding elastic locking strip 103 which undergoes elastic deformation toward the container body 6, allowing each elastic locking strip 103 to abut against a top peripheral side of the container body 6. Therefore, the locking between the container lid and the container body 6 is achieved.

Figure 3:
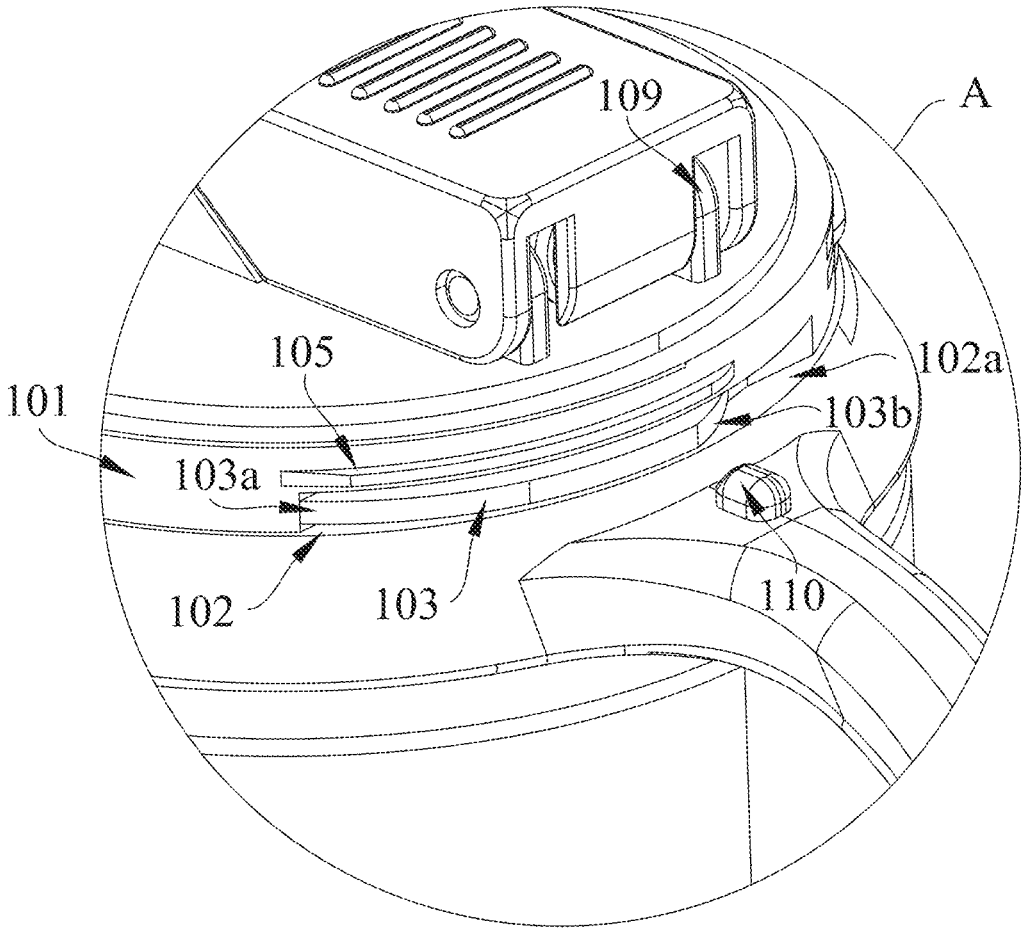
FIG. 3 is a partially enlarged view of area A in FIG. 2.

In some embodiments, as shown in FIG. 3, the second end 103*b* of each elastic locking strip 103 protrudes relative to the peripheral outer wall 101 of the lid body 1. The second end 103*b* of the elastic locking strip 103 is raised to maintain the locking state after the locking ring 2 is locked. After the locking ring 2 is locked, each elastic locking strip 103 undergoes elastic deformation to lock the container body 6. The raised second end 103*b* can retain the locking protrusion 202 on the peripheral inner wall 201 of the locking ring 2, preventing the locking ring 2 from rotating relative to the lid body 1 caused by a user's slightly accidentally touching, thereby further improving the locking effect of the locking ring 2 on the lid body 1.

Figure 11:
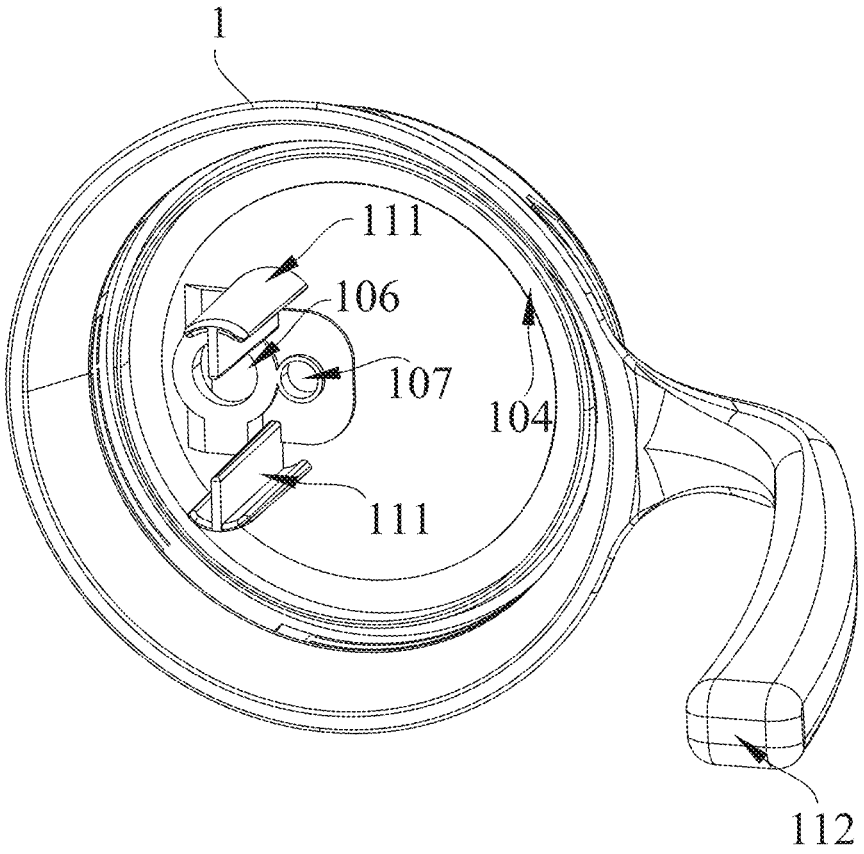
FIG. 11 is a perspective view of a lid body in the container lid according to some embodiments of the present disclosure.

In some embodiments, as shown in FIG. 11, a waterproof raised portion 104 is provided inside the lid body 1. A position of the waterproof raised portion 104 corresponds to a top of the container body 6 and protrudes toward the top of the container body 6. An outer dimension of the waterproof raised portion 104 match a concave part of the top of the container body 6. When the container lid engages with the top of the container body 6, the waterproof raised portion 104 fits with a top surface of the container body 6, thereby preventing the beverage in the container body 6 from flowing out of a connecting gap between the lid body 1 and the container body 6.

Figure 2:
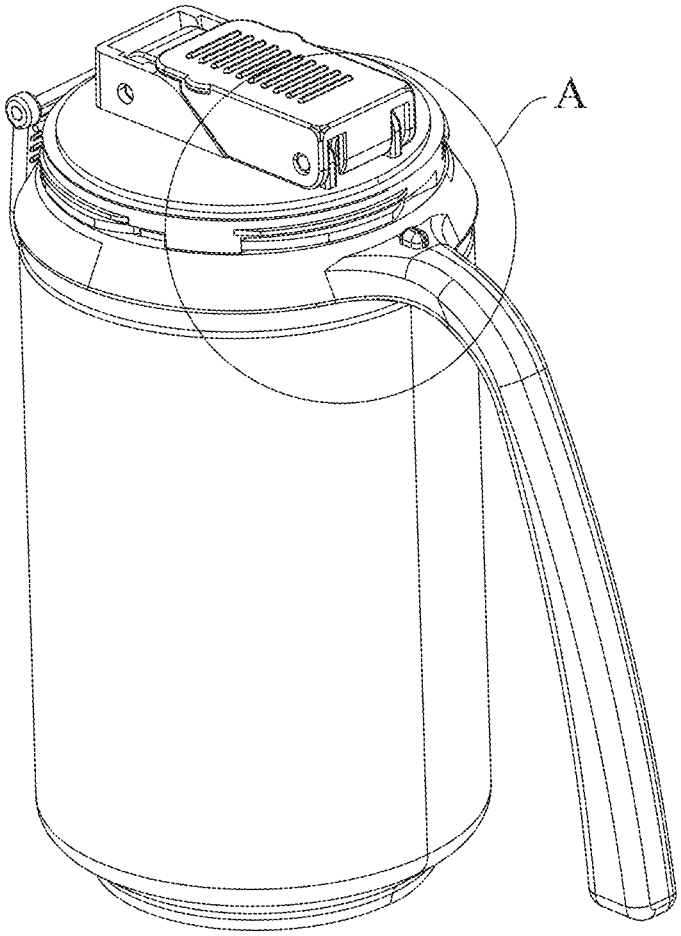
FIG. 2 is a perspective view of a container lid without a locking ring in a closed state at a second angle according to some embodiments of the present disclosure.
Figure 4:
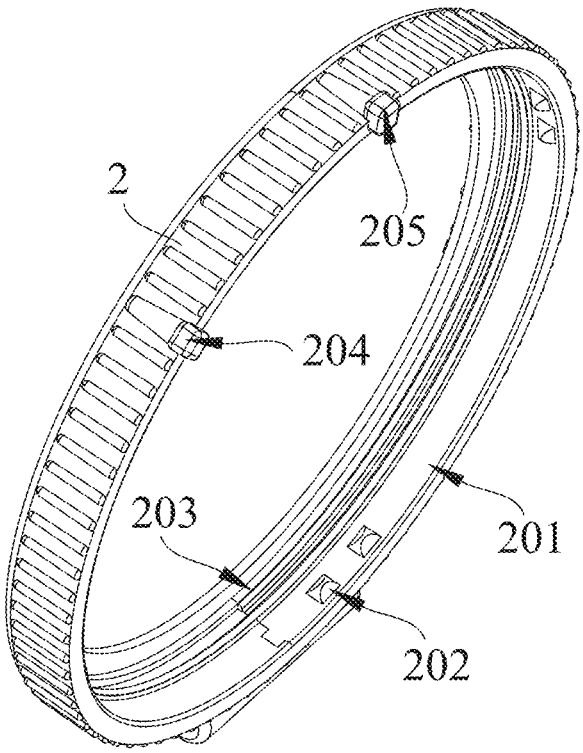
FIG. 4 is a perspective view of a locking ring of a container lid according to some embodiments of the present disclosure.
Figure 5:
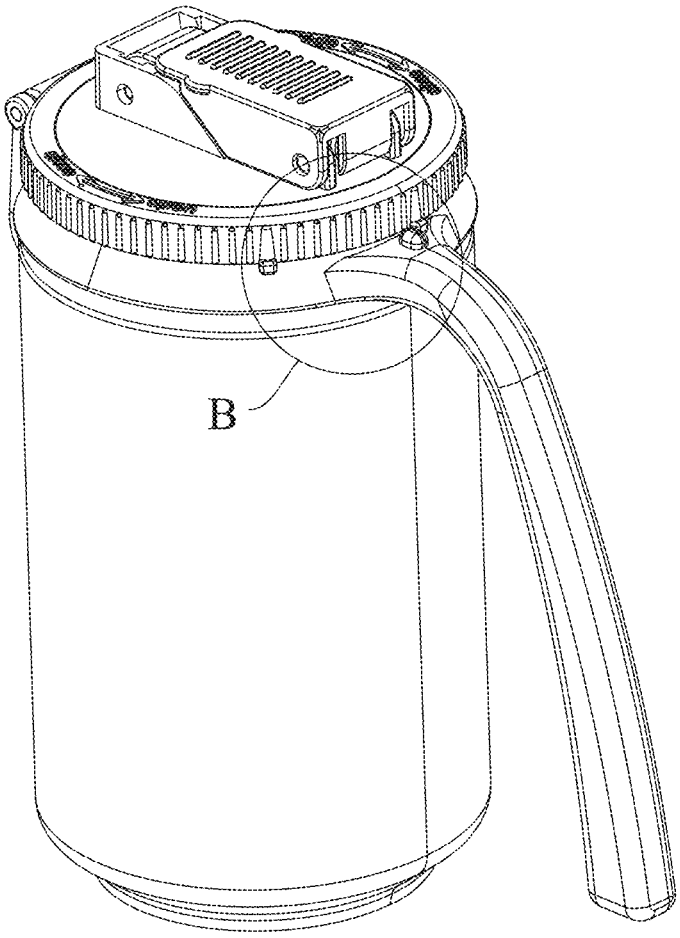
FIG. 5 is a perspective view of a container lid with a locking ring in a closed state at a second angle according to some embodiments of the present disclosure.
Figure 6:
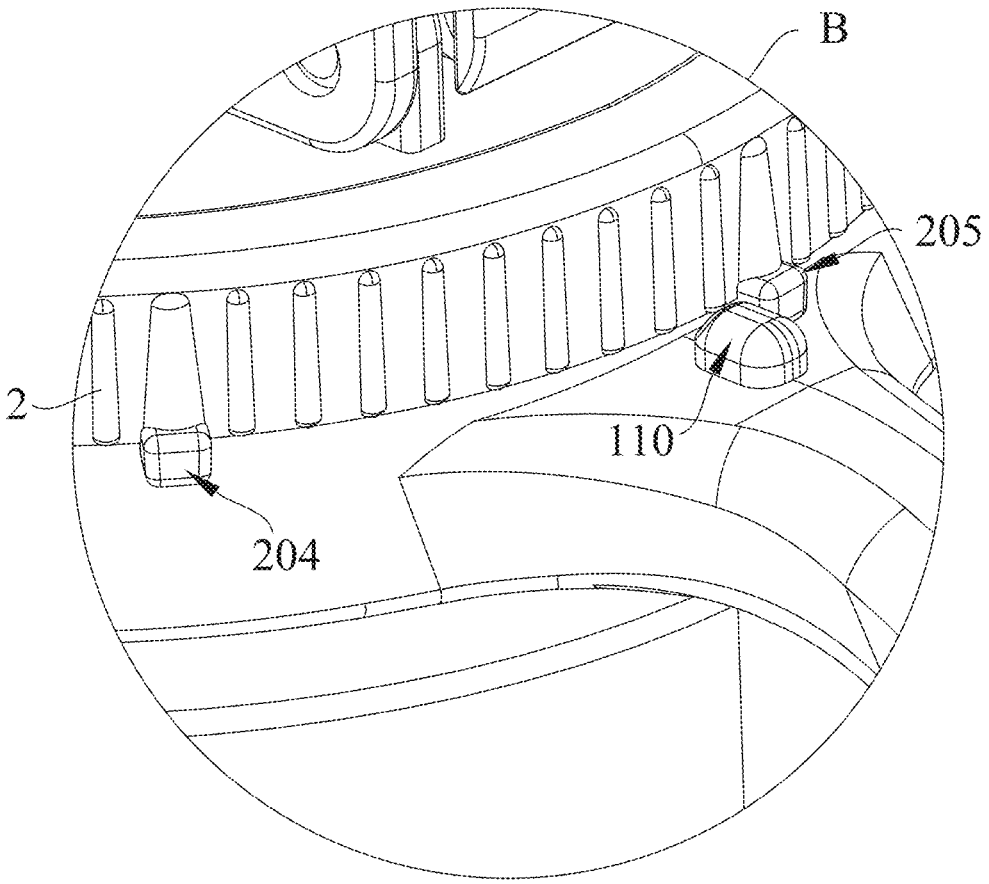
FIG. 6 is a partially enlarged view of area B in FIG. 5.
Figure 7:
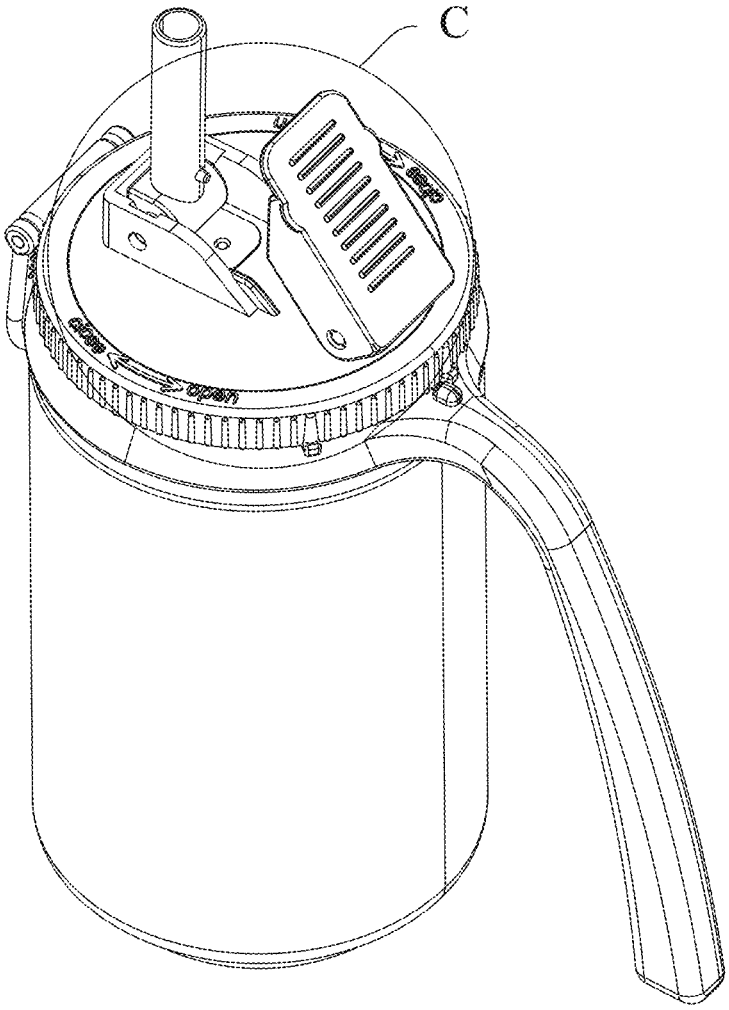
FIG. 7 is a perspective view of a container lid in an open state at a second angle according to some embodiments of the present disclosure.
Figure 8:
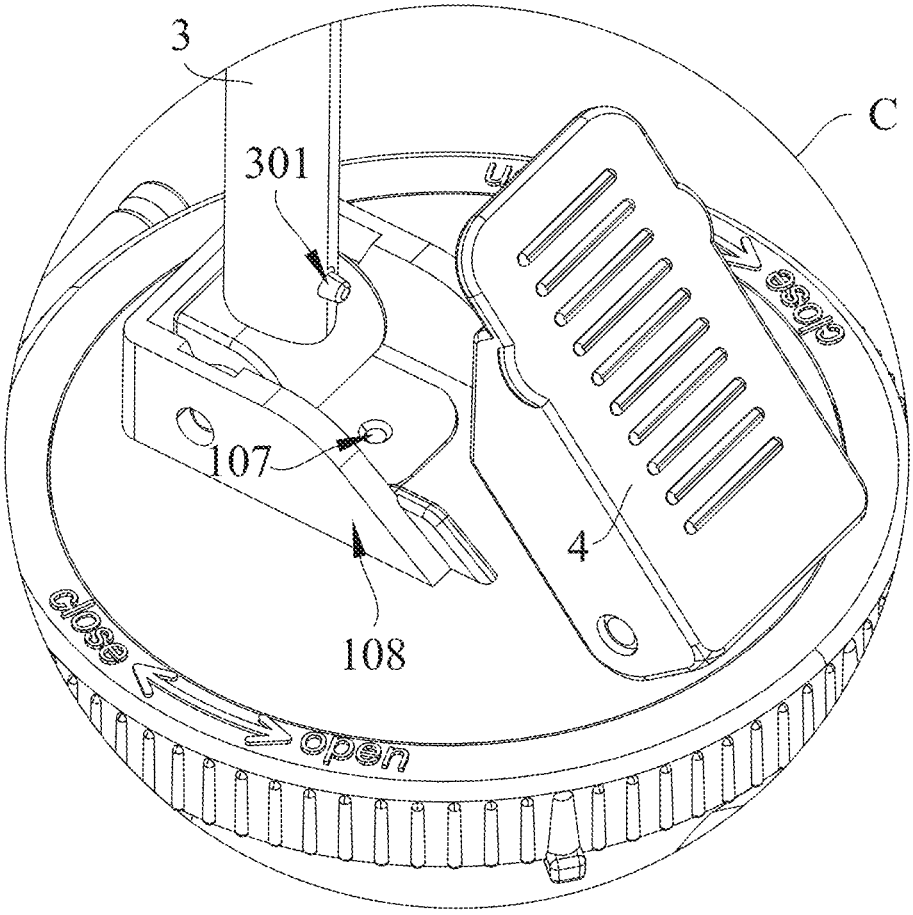
FIG. 8 is a partially enlarged perspective view of area C in FIG. 7.
Figure 9:
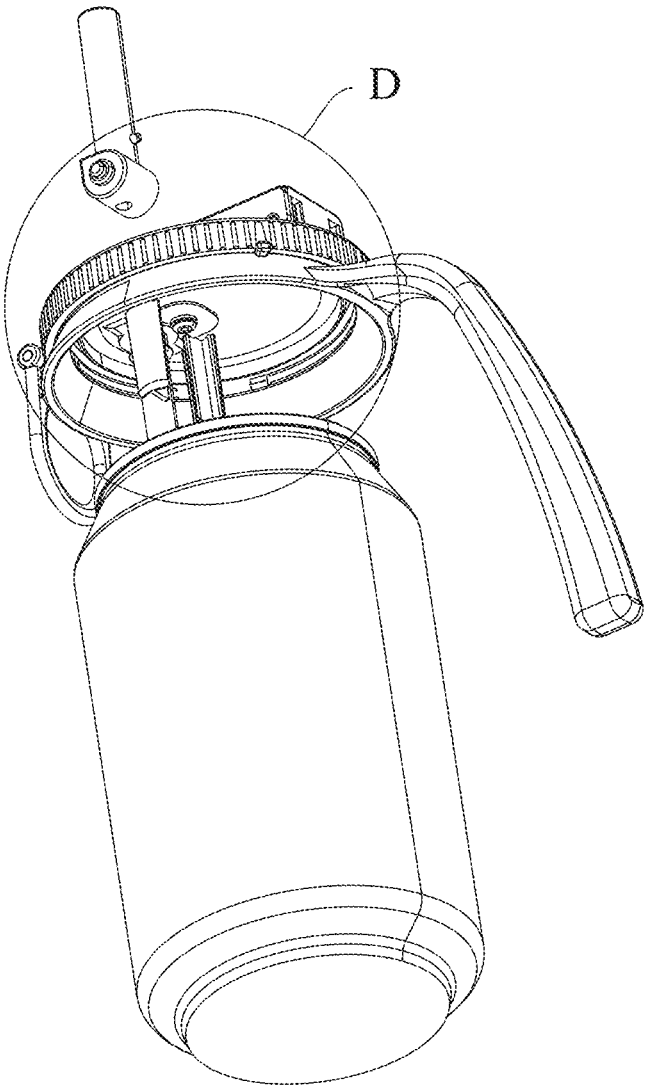
FIG. 9 is a perspective view of a container lid at a third angle according to some embodiments of the present disclosure.
Figure 10:
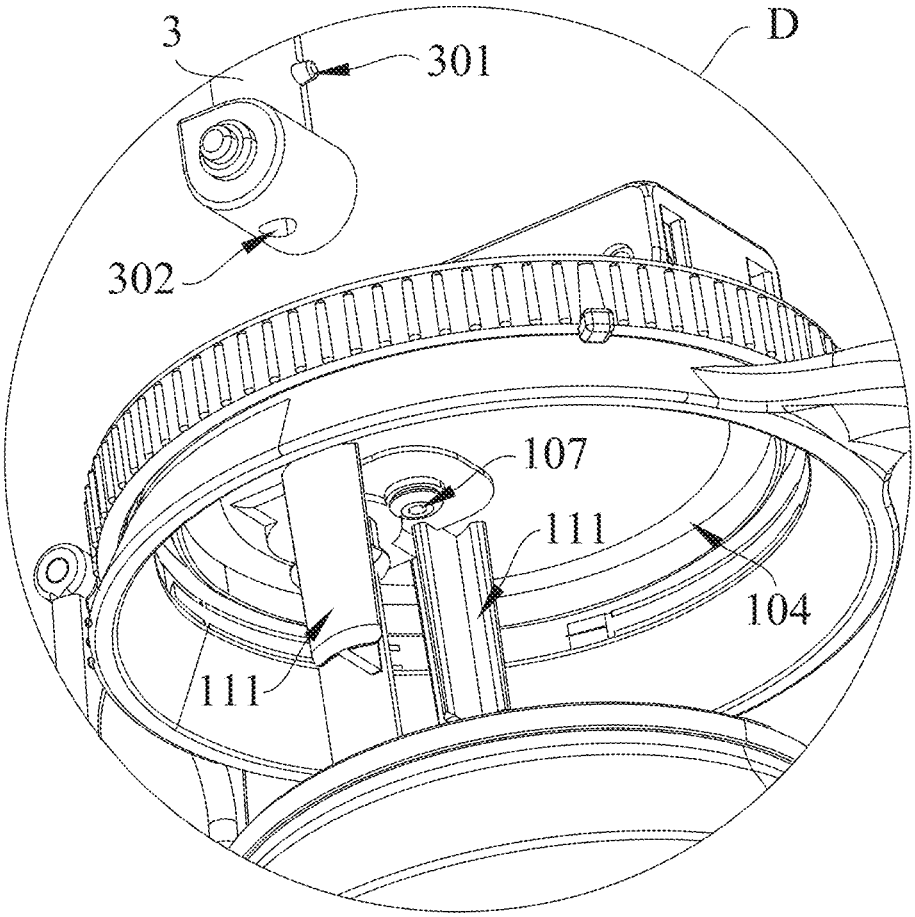
FIG. 10 is a partially enlarged view of area D in FIG. 9.

In some embodiments, as shown in FIG. 2 to FIG. 4, the peripheral outer wall 101 of the lid body 1 defines a first thread 105, and the peripheral inner wall 201 of the locking ring 2 defines a second thread 203 for engaging with the first thread 105. The second thread 203 of the locking ring 2 is engaged with the first thread 105 of the lid body 1, allowing the locking ring 2 to rotate relative to the lid body 1. With the engagement of the first thread 105 and the second thread 203, the firmness of the connection between the locking ring 2 and the lid body 1 is further improved.

In some embodiments, as shown in FIG. 1 to FIG. 11, the lid body 1 defines a first through hole 106 and a second through hole 107, and the first through hole 106 and the second through hole 107 are respectively configured to communicate with a pull-tab opening of the container body 6 after it is opened. The top of the lid body 1 is provided with a first hinge structure 108 and a second hinge structure 109. The first hinge structure 108 is hinged with a straw 3 and the second hinge structure 109 is hinged with a cover 4. A circumference of the straw 3 is arranged with a sealing protrusion 301 to seal the second through hole 107. When the straw 3 is rotated to a first angle relative to the lid body 1 by the first hinge structure 108, a channel 302 of the straw 3 communicates with the pull-tab mouth through the first through hole 106 and the pull-tab mouth also communicates with an outside of the container lid through the second through hole 107, allowing a user to drink the beverage inside the container body 6 with the straw 3. When the straw 3 is rotated to a second angle relative to the lid body 1 by the second hinge structure 109, the outer wall of the straw 3 seals the first through hole 106, cutting the communication between the channel 302 of the straw 3 and the pull-tab mouth, and the sealing protrusion 301 on the straw 3 simultaneously seals the second through hole 107, allowing the container lid to seal the container body 6. Finally, the cover 4 can be pivoted by the second hinge structure 109 to press the straw 3 at the second angle to prevent the straw 3 from rotating accidentally and further improve the sealing effect of the straw 3 on the first through hole 106 and the second through hole 107.

In some embodiments, as shown in FIG. 1 to FIG. 6, the lid body 1 is provided with a first limiting structure 110, and a peripheral side of the locking ring 2 is provided with a second limiting structure 204 and a third limiting structure 205 at intervals. When the container lid and the container body 6 are unlocked, the first limiting structure 110 is located between the second limiting structure 204 and the third limiting structure 205, the first limiting structure 110 fits with the second limiting structure 204, each locking protrusion 202 is disposed into its corresponding escape groove 102*a*, and each elastic locking strip 103 does not undergo elastic deformation. When the container lid is locked with the container body 6, the locking ring 2 rotates relative to the lid body 1, allowing the first limiting structure 110 to move from the second limiting structure 204 toward the third limiting structure 205 and then fits with the third limiting structure 205. During this process, each locking protrusion 202 abuts against its corresponding elastic locking strip 103, allowing each elastic locking strip 103 to undergo elastic deformation toward the inside of the lid body 1, thereby locking the container lid with the container body 6. During the relative rotation between the locking ring 2 and the lid body 1, the first limiting structure 110 is only configured to move between the second limiting structure 204 and the third limiting structure 205, thereby preventing excessive rotational displacement by the user and mitigating damages to the container lid.

In some embodiments, as shown in FIG. 7 to FIG. 11, two guide ridges 111 are provided inside the container lid, and the two guide ridges 111 are provided corresponding to the pull-tab mouth of the container and extend toward the inside of the can. A spacing distance between the two guide ridges 111 is adapted to a size of the pull-tab mouth, allowing the two guide ridges 111 to simultaneously extend into an interior of the container along an edge of the pull-tab mouth. The two guide ridges 111 container position the lid body 1 through the edge of the pull-tab mouth when the container lid is engaged with the container body 6. When a user uses an extra tube to penetrate into the channel 302 of the straw 3, so as to drink the beverage the interior of the can, the guide ridge 111 also prevents the sharp edge of the pull-tab mouth from damaging the tube.

In some embodiments, as shown in FIG. 1, a handle 112 is provided on the peripheral outer wall 101 of the lid body 1 of the container lid, and a user container hold the container body locked by the container lid with the handle 112.

In some embodiments, as shown in FIG. 1, the peripheral outer wall 101 of the lid body 1 of the container lid is arranged with a third hinge structure 113, which is hinged with a hanging ring 5, and a user container hang the container body locked with the container lid with the hanging ring 5.

From the above description, it can be seen that the above embodiments of the present disclosure achieve the following technical effects.

The lid body 1 of the container lid is sleeved on the top of the container body 6 of the opened can, and the container lid is locked or detached from the top of the container body 6 by rotating the locking ring 2. After a user sleeves the lid body 1 on the top of the container body 6, the locking protrusion 202 on the locking ring 2 is rotated to allow the locking protrusion 202 to abut against the corresponding elastic locking strip 103. Under the pressure of the locking protrusion 202 on the elastic locking strip 103, the elastic locking strip 103 is elastically deformed and locked against the top peripheral side of the container body 6, realizing the connection between the container lid and the can. The user can drink the beverage inside the container with the straw 3 taken out from the cover 4. When the user does not intend to finish the beverage in the can, the straw 3 and cover 4 are configured to reseal the container mouth. The hanging ring 5 and handle 112 provided on the lid body 1 facilitate the user to hang or hold the container body 6 after being locked with the container lid.

Compared with the related art, when the locking ring 2 rotates relative to the lid body 1, the container lid enables each locking protrusion 202 on the peripheral inner wall 201 of the locking ring 2 to abut against the corresponding elastic locking strip 103 on the peripheral outer wall 101 of the cover 1, causing each elastic locking strip 103 to undergo elastic deformation toward the container body 6, finally achieving the locking between the container lid and the container body 6. The container lid avoids the problem of directly applying external vertical pressure to fasten and seal the can, which may result in serious deformation of the container body 6 of the can, and effectively solves the technical problems existing in the existing products while achieving repeated opening and sealing of canned beverages.

The above description only illustrates some embodiments of the present disclosure, and does not limit the protection scope of the present disclosure. All equivalent structural changes made by using the contents in the specification and drawings under the concept of the present disclosure, or directly/indirectly used in other related technical fields are included in the protection scope of the present disclosure.

What is claimed is:

1. A container lid configured for sealing a top of a container body to allow a pull-tab mouth of the container body to be repeatedly opened or sealed, the container lid comprising:

a lid body having a peripheral outer wall, the peripheral outer wall arranged with at least one elastic locking strip, the at least one elastic locking strip configured to undergo elastic deformation toward an inside of the lid body under an external force; and a locking ring having a peripheral inner wall, the peripheral inner wall sleeved on the peripheral outer wall to rotate coaxially along the peripheral outer wall, and the peripheral inner wall arranged with at least one locking protrusion corresponding to the at least one elastic locking strip;

wherein the peripheral outer wall defines at least one through-groove extending along a peripheral direction of the peripheral outer wall, each of the least one elastic locking strip is disposed within a corresponding one of the at least one through-groove; and wherein the at least one locking protrusion abuts against the at least one elastic locking strip to allow the at least one elastic locking strip to fasten the top of the container body by elastic deformation in response to the locking ring rotating to a preset angle relative to the lid body.

2. The container lid according to claim 1, wherein an interior of the lid body is arranged with a guide ridge, and the guide ridge is configured to penetrate into the pull-tab mouth of the container body.

3. The container lid according to claim 2, wherein each of the at least one elastic locking strip comprises a first end and a second end, the first end of each of the at least one elastic locking strip is connected to an end of one of the at least one through-groove, and the second end of each of the at least one elastic locking strip is spaced apart from another end of one of the at least one through-groove by a preset distance.

4. The container lid according to claim 3, wherein the peripheral outer wall defines a first thread, the peripheral inner wall defines a second thread corresponding to the first thread, and the locking ring is configured to rotate coaxially relative to the lid body by an engagement of the second thread with the first thread.

5. The container lid according to claim 3, wherein the second end of each of the at least one elastic locking strip protrudes relative to the peripheral outer wall.

6. The container lid according to claim 1, wherein an interior of the lid body is arranged with a waterproof raised portion, and the waterproof raised portion is configured to seal the container body.

7. The container lid according to claim 2, wherein a top of the lid body defines a first through hole and a second through hole, and the first through hole and the second through hole are configured to communicate with the pull-tab mouth;

the top of the lid body is further provided with a first hinge structure and a second hinge structure, the first hinge structure is hinged with a straw, and the second hinge structure is hinged with a cover;

a peripheral side of the straw is provided with a sealing protrusion, and a size of the sealing protrusion fits with a size of the second through hole;

a channel of the straw communicates with the first through hole in response to the straw being rotated to a first angle by the first hinge structure;

the sealing protrusion seals the second through hole in response to the straw being rotated to a second angle by the second hinge structure.

8. The container lid according to claim 1, wherein a handle is provided on the peripheral outer wall.

9. A container lid configured for sealing a top of a container body to allow a pull-tab mouth of the container body to be repeatedly opened or sealed, the container lid comprising:

a lid body having a peripheral outer wall, a locking ring having a peripheral inner wall, the peripheral inner wall sleeved on the peripheral outer wall to rotate coaxially along the peripheral outer wall; and a handle arranged on the peripheral outer wall, a first limiting protrusion being provided on the handle;

wherein a peripheral side of the locking ring is provided with a second limiting protrusion and a third limiting protrusion at intervals; the first limiting protrusion is configured to rotate to abut against the second limiting protrusion in response to the container lid and the container body being unlocked; the first limiting protrusion is configured to rotate to abut against the third limiting protrusion in response to the container lid and the container body being locked.

10. The container lid according to claim 9, wherein the peripheral outer wall defines at least one through-groove extending along a peripheral direction of the peripheral outer wall, the peripheral outer wall is arranged with at least one elastic locking strip, each of the least one elastic locking strip is disposed within a corresponding one of the at least one through-groove;

the peripheral inner wall is arranged with at least one locking protrusion corresponding to the at least one elastic locking strip;

the at least one locking protrusion is configured to abut against the at least one elastic locking strip to allow the at least one elastic locking strip to move toward an inside of the lid body under to fasten the top of the container body in response to the locking ring rotating to a preset angle relative to the lid body.

11. The container lid according to claim 10, wherein each of the at least one elastic locking strip comprises a first end and a second end, the first end of each of the at least one elastic locking strip is connected to an end of one of the at least one through-groove, and the second end of each of the at least one elastic locking strip is spaced apart from another end of one of the at least one through-groove by a preset distance to form an escape groove.

12. The container lid according to claim 11, wherein each of the at least one locking protrusion is disposed into its corresponding escape groove and does not undergo elastic deformation in response to the container lid and the container body being unlocked.

* * * * *